US008164557B2

(12) United States Patent
Kubota et al.

(10) Patent No.: US 8,164,557 B2
(45) Date of Patent: Apr. 24, 2012

(54) LIQUID CRYSTAL DISPLAY DEVICE AND METHOD FOR DRIVING THE SAME

(75) Inventors: Daisuke Kubota, Atsugi (JP); Takeshi Nishi, Atsugi (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 1043 days.

(21) Appl. No.: 11/255,918

(22) Filed: Oct. 24, 2005

(65) Prior Publication Data

US 2006/0092117 A1 May 4, 2006

(30) Foreign Application Priority Data

Oct. 29, 2004 (JP) ..... 2004-316058

(51) Int. Cl.
*G09G 3/36* (2006.01)

(52) U.S. Cl. ..... 345/96; 345/87; 345/89

(58) Field of Classification Search ..... 345/96, 345/53, 94, 87, 89, 90, 92, 95; 349/33, 34, 349/37

See application file for complete search history.

(56) References Cited

U.S. PATENT DOCUMENTS

| | | | | |
|---|---|---|---|---|
| 3,891,307 | A * | 6/1975 | Tsukamoto et al. | 252/299.7 |
| 4,634,226 | A * | 1/1987 | Isogai et al. | 345/96 |
| 4,755,812 | A * | 7/1988 | Ohta et al. | 345/94 |
| 4,946,260 | A * | 8/1990 | Fujumura et al. | 349/170 |
| 5,010,327 | A * | 4/1991 | Wakita et al. | 345/89 |
| 5,026,144 | A * | 6/1991 | Taniguchi et al. | 349/37 |
| 5,151,803 | A | 9/1992 | Wakita et al. | |
| 5,216,415 | A * | 6/1993 | Ono et al. | 345/94 |
| 5,424,753 | A * | 6/1995 | Kitagawa et al. | 345/94 |
| 6,046,790 | A * | 4/2000 | Hara et al. | 349/172 |
| 6,078,304 | A * | 6/2000 | Miyazawa | 345/88 |
| 6,219,019 | B1 * | 4/2001 | Hasegawa et al. | 345/96 |
| 6,396,469 | B1 * | 5/2002 | Miwa et al. | 345/87 |
| 6,567,063 | B1 | 5/2003 | Okita | |
| 6,753,835 | B1 | 6/2004 | Sakai | |
| 6,825,824 | B2 | 11/2004 | Lee | |
| 6,876,351 | B2 | 4/2005 | Tokonami et al. | |

(Continued)

FOREIGN PATENT DOCUMENTS

EP 0949605 A 10/1999

(Continued)

*Primary Examiner* — Amare Mengistu
*Assistant Examiner* — Koosha Sharifi-Tafreshi
(74) *Attorney, Agent, or Firm* — Eric J. Robinson; Robinson Intellectual Property Law Office, P.C.

(57) ABSTRACT

In the case of conducting an overdriving with a liquid crystal display device, the circuit for comparing the previous and present gray-scale data, the circuit for converting the gray-scale data upon the comparison result, and the like complicate the structure of the liquid crystal display device. Further, since hold driving by which the voltage applied is kept throughout one frame period is conducted in a liquid crystal display device, it is not sufficient to decrease the rise time due to high applied voltage for a countermeasure against blur of moving images. In the present invention, in one frame period, a high voltage is applied to a liquid crystal element and a constant voltage is applied after the high voltage is applied. The absolute value of the high voltage is equal to or higher than the constant voltage, in other words, equal to or higher than a reference voltage. Further, a rectangular wave within the high voltage application period (also referred to as a pulse) has a plurality of pulses having periods shorter than the rise time $\tau_{ON}$.

7 Claims, 15 Drawing Sheets

U.S. PATENT DOCUMENTS

| | | | | |
|---|---|---|---|---|
| 6,888,522 | B1 * | 5/2005 | Shibata et al. | 345/87 |
| 6,947,034 | B2 | 9/2005 | Kwon | |
| 7,038,651 | B2 * | 5/2006 | Nitta et al. | 345/98 |
| 7,154,459 | B2 | 12/2006 | Lee | |
| 7,365,724 | B2 | 4/2008 | Lee | |
| 7,667,680 | B2 | 2/2010 | Lee | |
| 2002/0024509 | A1 * | 2/2002 | Yamada et al. | 345/204 |
| 2002/0097214 | A1 * | 7/2002 | Song | 345/96 |
| 2002/0097252 | A1 * | 7/2002 | Hirohata | 345/690 |
| 2003/0006950 | A1 * | 1/2003 | Saishu et al. | 345/87 |
| 2003/0030612 | A1 * | 2/2003 | Yip et al. | 345/89 |
| 2004/0001054 | A1 * | 1/2004 | Nitta et al. | 345/204 |
| 2010/0103158 | A1 | 4/2010 | Lee | |

FOREIGN PATENT DOCUMENTS

| | | | |
|---|---|---|---|
| EP | 1122711 | A | 8/2001 |
| EP | 1995718 | A | 11/2008 |
| JP | 07-121143 | | 5/1995 |
| JP | 11-296150 | A | 10/1999 |
| JP | 11-326957 | A | 11/1999 |
| JP | 2001-265298 | A | 9/2001 |

* cited by examiner

A
B
C

Time (s)

A
B
C

0V
CONSTANT VOLTAGE APPLICATION 0V
time

LIQUID CRYSTAL DISPLAY DEVICE AND METHOD FOR DRIVING THE SAME

BACKGROUND OF THE INVENTION

1. Field of the Invention

The invention relates to a liquid crystal display device having high response speed and a method for driving the same using applied voltage waveform for achieving high response speed.

2. Description of the Related Art

An active matrix driving method has conventionally been used for conducting multiple gray-scale display using a liquid crystal display device. The active matrix driving method is a method in which a reference voltage corresponding to a display gray-scale is selected with an analog switch, and the selected voltage is applied to a liquid crystal display device to display a desired display gray-scale. One gray-scale is generally displayed in a period in which an image is displayed (one frame), and a predetermined reference voltage corresponding to the desired gray-scale is applied to the liquid crystal display device.

When change in the voltage applied to the liquid crystal display device is small, the time within which the desired gray-scale is obtained (response time, namely, rise time plus fall time) tends to increase. Increase in response time cause a problem of blur since the response of a liquid crystal is late when the change in voltage applied to the liquid crystal display device, for example, change from a halftone 1 to a halftone 2 is small. Correspondingly, for example, comparing the gray-scale data for the previous time and the next time, the voltage to be applied is increased when the gray-scale data for the previous time is more, and is reduced when the gray-scale data for the present time is less, conventionally. Thus, the rise time is reduced by overdriving, for example, by making the voltage actually applied or a part thereof higher or lower than the reference voltage corresponding to the desired gray-scale, thereby solving the problem.

In the case of conducting such overdriving, the scale of circuit becomes larger, which causes a fear of high cost. Correspondingly, a driving method with which response speed of gray-scale change of a liquid crystal display panel can be improved using small memory capacitance has been proposed (Reference 1: Japanese Patent Laid-Open No. 07-121143).

However, in the case of conducting such overdriving with a liquid crystal display device, the circuit for comparing the previous and present gray-scale data, the circuit for converting the gray-scale data upon the comparison result, and the like complicate the structure of the liquid crystal display device.

Further, since hold driving by which the voltage applied is kept throughout one frame period is conducted in a liquid crystal display device, it is not sufficient to decrease the rise time due to high applied voltage for a countermeasure against blur of moving images.

BRIEF SUMMARY OF THE INVENTION

The present invention has been made in view of the above problems and it is a feature of the present invention that one frame period includes a high voltage application period for applying a high voltage to a liquid crystal element and a constant voltage application period for applying a constant voltage after the high voltage application period. The high voltage application period includes a plurality of pulses having periods shorter than the rise time of a liquid crystal display device, and the absolute value of the high voltage is higher than the constant voltage, in other words, higher than a reference voltage. Note that, in this specification, a period in which high voltage is applied is referred to as a high voltage application period and a period in which a constant voltage is applied is referred to as a constant voltage application period, as above. Further, a short waveform within the high voltage application period (also referred to as a pulse) has a plurality of pulses having periods shorter than the rise time $\tau_{ON}$. The period in which a short period pulse is applied is also referred to a short period pulse period.

Thus, using a pulse for applying high voltage, the rise time of a liquid crystal element in the liquid crystal display device can be reduced. Further, since the rise time is reduced, the response time (rise time ($\tau_{ON}$) plus fall time ($\tau_{OFF}$)) is also reduced. Therefore, even in the case where a no-voltage application period is provided in addition, multiple gray scales can be controlled in one frame. Further, the light transmission intensity characteristics can be impulse type.

The present invention provides a method for driving a liquid crystal display device, in which one frame period includes a high voltage application period for applying a high voltage to a liquid crystal element and a constant voltage application period for applying a constant voltage after the high voltage application period. The high voltage application period includes a plurality of pulses having periods shorter than the rise time of a liquid crystal display device, and the absolute value of the high voltage is higher than the constant voltage.

In order to achieve such a driving method, a function of applying high voltage to a liquid crystal element, and a function of applying a constant voltage thereto after the high voltage application are provided. These functions may be integrated on a glass substrate where a pixel area is formed, or may be mounted on a printed substrate.

Further, preferably, in the present invention, it is a feature of the present invention that after a constant voltage application period in which a constant voltage is applied to a liquid crystal element, a period in which a voltage that is lower than the absolute value of the threshold voltage is applied or a period in which any voltage is not applied (hereinafter referred to as a no voltage application period) is provided. By providing a period in which a voltage that is lower than the absolute value of threshold voltage is applied, liquid crystal molecules can always be once returned to the reference state. Accordingly, without comparing two successive data, the present time data may be compared with only the reference state. Therefore, a complicated process circuit is not required, and the complexity of circuitry can be prevented. Note that the threshold voltage here is referred to a voltage at which the director direction (an average direction of long axes of liquid crystal molecules is referred to as director) of liquid molecules begins to change by an electric filed applied to a liquid crystal element included in a liquid crystal display device.

Thus, the present invention provides a method for driving a liquid crystal display device, in one frame period, having a period in which a high voltage application period in which a high voltage is applied to a liquid crystal element, a constant voltage application period in which a constant voltage is applied after the high voltage application period, and a no-voltage application period after the constant voltage application period. Further, the high voltage application period includes a plurality of pulses each having shorter frequency than the rise time of the liquid crystal display device, and the absolute value of the high voltage value is higher than the voltage value of the constant voltage.

In order to achieve such a driving method, a function of controlling so as to apply a voltage that is lower than an absolute value of a threshold voltage or a function for controlling so as not to apply any voltage is provided after the constant voltage application period for applying a constant voltage. The function may be integrated on a glass substrate where a pixel area is formed, or may be mounted on a printed substrate.

The present invention provides a liquid crystal display device including a function of applying a high voltage to a liquid crystal element, and a function of applying a constant voltage. Further, one frame period includes a high voltage application period for applying a high voltage and a constant voltage application period for applying a constant voltage after the period for applying a high voltage. The period for applying a high voltage includes a plurality of pulses having periods shorter than the rise time of the liquid crystal display device, and the absolute value of the high voltage value is higher than the voltage value of the constant voltage.

The present invention provides a liquid crystal display device including a function of applying a high voltage to a liquid crystal element, a function of applying a constant voltage, and a function of controlling so as to apply a voltage that is lower than an absolute value of a threshold voltage (or a function for controlling so as not to apply any voltage). Further, one frame period includes a high voltage application period for applying the high voltage; a constant voltage application period for applying the constant voltage after the period for applying the high voltage; and a no-voltage application period for applying the voltage that is lower than an absolute voltage of a threshold voltage (or for controlling so as not to apply any voltage) after the period for applying the constant voltage. The period for applying the high voltage includes a plurality of pulses having periods shorter than the rise time of the liquid crystal display device, and the absolute value of the high voltage value is higher than the voltage value of the constant voltage.

In the above driving method and a liquid crystal display device using the above driving method, a voltage of at least one of the plurality of pulses may have a polarity opposite to the voltage of the constant voltage. The period for applying the plurality of pulses may be almost equal to the rise time of the liquid crystal display device. Further, the period for applying the voltage that is lower than an absolute voltage of a threshold voltage (or for controlling so as not to apply any voltage) may be almost equal to the fall time of the liquid crystal display device.

A waveform for applying such above voltage (hereinafter referred to as a voltage application waveform, or simply a voltage waveform or a voltage application pattern) is applied to a normally black liquid crystal display device. Thus, a black display period can be inserted between two frames that are temporally successive, preferably, in the no-voltage application period, and blur of moving images can be reduced.

In other words, the black display period may be inserted using the no-voltage application period in which a voltage that is lower than the absolute value of the threshold voltage is applied (or any voltage is not applied).

The present invention can provide a method for driving a liquid crystal display device, one frame period has a voltage application waveform including a high voltage application period using the above pulses and a constant voltage application period for keeping the desired gray-scale. One of specific method for driving a liquid crystal display device of the present invention is as follows. As a method for applying the above voltage application waveform to the liquid crystal display device, a frame period for displaying an image (gray-scale) is divided into equal subframes having a unit time of the application time of a pulse (that is, the pulse width) in the above high voltage application period, and the liquid crystal display device is driven by an active matrix driving method using the subframe as one unit time. The above method for driving a liquid crystal display device can be achieved by increasing the frame frequency from that of a conventional active matrix driving method. Therefore, the driving method can be conducted without the complexity of circuitry.

The present invention provides a method for driving a liquid crystal display device, in which one frame period includes a high voltage application period for applying a high voltage to a liquid crystal element and a constant voltage application period for applying a constant voltage after the high voltage application period. The high voltage application period includes a plurality of pulses having periods shorter than the rise time of a liquid crystal display device, and the absolute value of the high voltage is higher than the constant voltage. Further, the liquid crystal display device can be driven using the width of the pulse as one time unit.

The present invention provides a method for driving a liquid crystal display device, in which one frame period includes a high voltage application period for applying a high voltage to a liquid crystal element, a constant voltage application period for applying a constant voltage after the period for applying a high voltage, and a period for applying a voltage that is lower than an absolute voltage of a threshold voltage (or for not applying any voltage) after the period for applying a constant voltage. The period for applying a high voltage includes a plurality of pulses having periods shorter than a rise time of the liquid crystal display device, and the absolute value of the high voltage value is higher than a voltage value of the constant voltage. Further, the liquid crystal display device can be driven using the width of the pulse as one time unit.

The present invention can reduce blur of moving images of a liquid crystal display device. That is because the transmitted light intensity characteristics can be an impulse type instead of a hold type due to a voltage application waveform according to the present invention. Further, in that case, the voltage application waveform and the application method according to the present invention can be obtained by increasing the frame frequency from that of a conventional active matrix driving method. Therefore, the circuit is not complicated.

DETAILED DESCRIPTION OF THE INVENTION

Figures 1A, 1B, 1C, 1D, 1E:
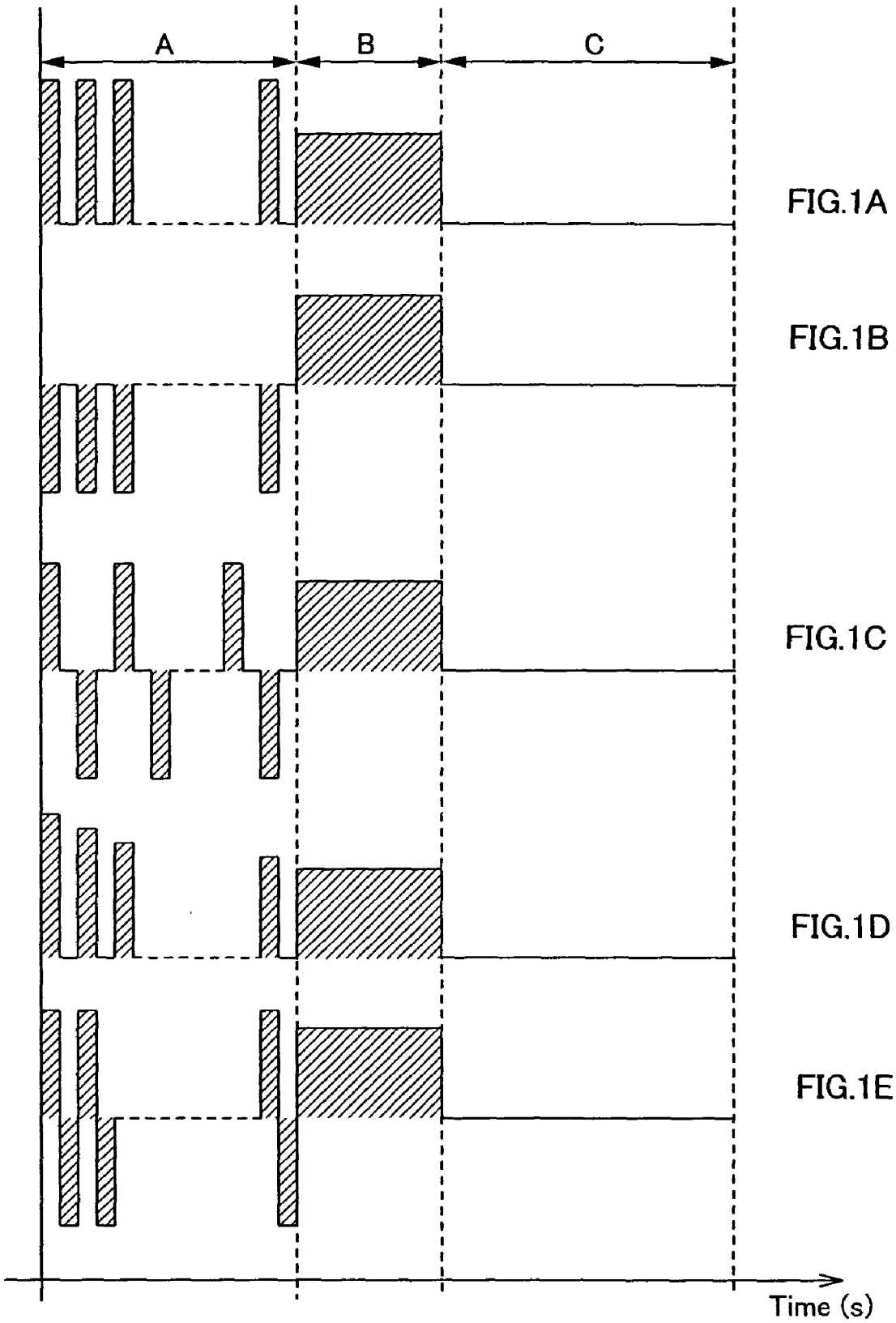
FIGS. 1A to 1E show voltage application waveforms for a liquid crystal display device in the present invention.

Embodiment modes of the invention will be described below with reference to the drawings. Note that the invention is not limited to the following descriptions and various changes may be made in modes and details without departing from the spirit and the scope of the invention. In the drawings for describing the embodiment modes, the same reference numerals are commonly given to like components, and the components will not be described repeatedly.

Embodiment Mode 1

In embodiment mode, a gray scale display method will be described with reference to FIGS. 3 to 6.

Figure 3:
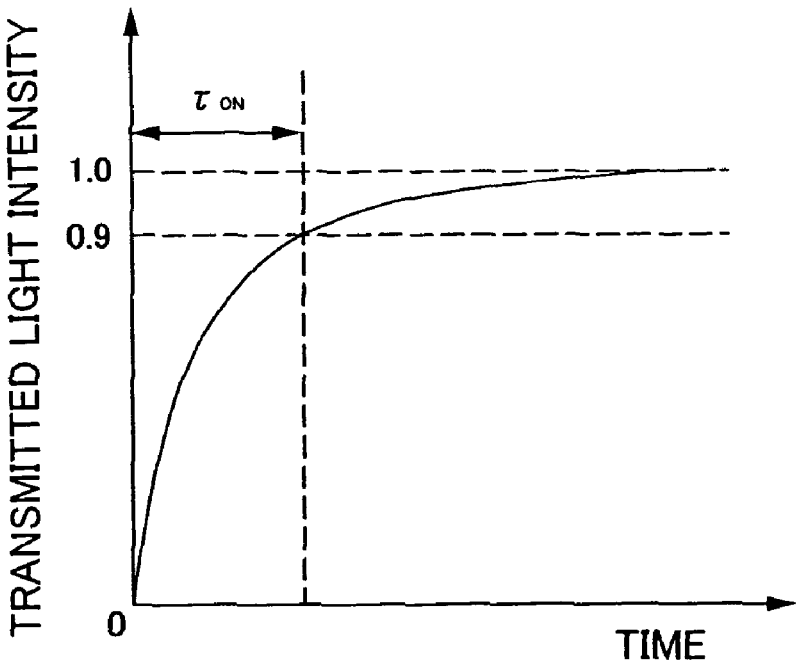
FIG. 3 shows a transmitted light intensity transient response characteristics of a liquid crystal display device due to voltage application.
Figure 4:
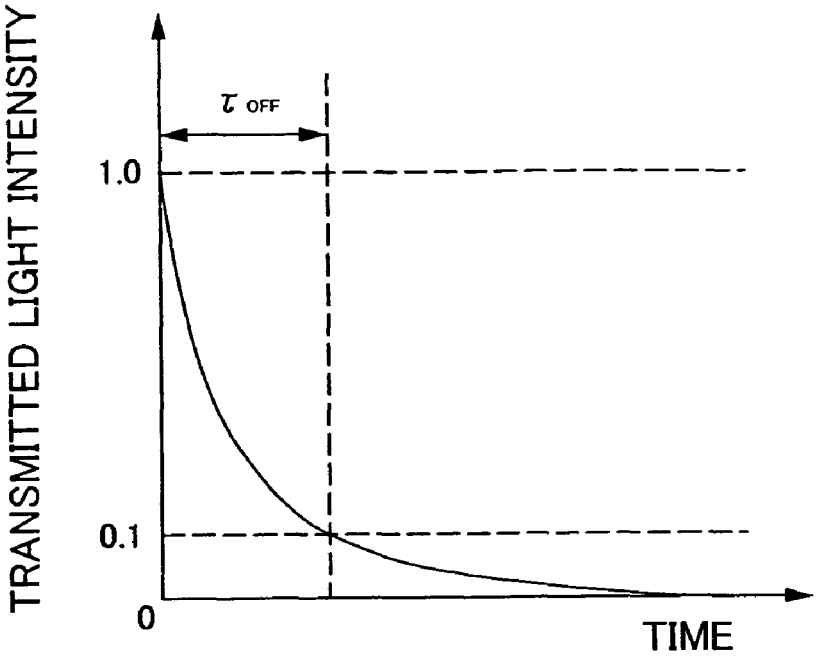
FIG. 4 shows a transmitted light intensity transient response characteristics of a liquid crystal display device due to voltage elimination.

As for a transmitted light intensity characteristics showing the transmitted light intensity corresponding to the voltage applied to a liquid crystal display device, in FIG. 3, the rise time of the voltage of OFF to ON is equivalent to time within which the transmitted light intensity changes from 0 to 0.9, and is represented by $\tau_{ON}$. Further, in FIG. 4, the fall time of the voltage of ON to OFF is equivalent to time within which the transmitted light intensity changes from 1.0 to 0.1, and is represented by $\tau_{OFF}$.

Figure 5:
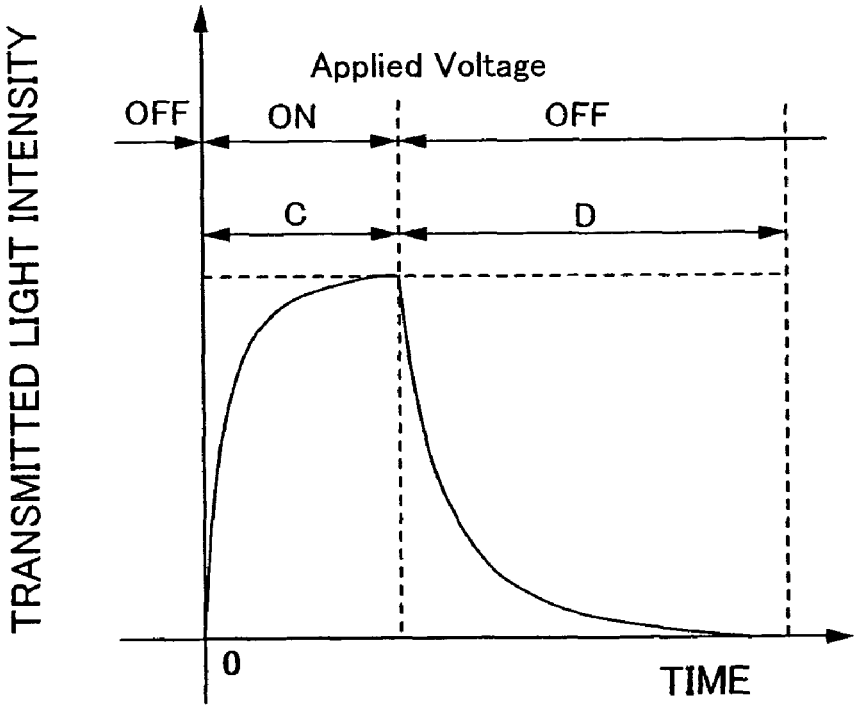
FIG. 5 shows a rising characteristic of a liquid crystal display device compared with the falling characteristic.

$\tau_{ON}$ and $\tau_{OFF}$ differ in actual liquid crystal driving. Specifically, as shown in FIG. 5, $\tau_{OFF}$ would be longer than $\tau_{ON}$. Further, since $\tau_{OFF}$ is longer than $\tau_{ON}$, when a voltage application waveform having extremely short frequency with respect to the response speed ($\tau_{ON}+\tau_{OFF}$) is successively applied, the voltage applied state would almost kept because the liquid crystal molecules can not respond in accordance with the voltage application waveform.

Further, as for a voltage application waveform in accordance with the present invention, since the pulse width of one pulse in the initial stage of the voltage application period is shorter than $\tau_{ON}$, the maximum change in the transmitted light intensity can not be achieved with one pulse. However, since the time before the next pulse is applied is much shorter than ($\tau_{ON}$ plus $\tau_{OFF}$), the next pulse is applied before the transmitted light intensity of the liquid crystal recovers OFF state even when the applied voltage is temporally OFF. Consequently, the liquid crystal element can be controlled accurately.

Further, by successively conducting the pulse application, the maximum value of transmitted light intensity can be obtained with a liquid crystal display device.

Figure 6:
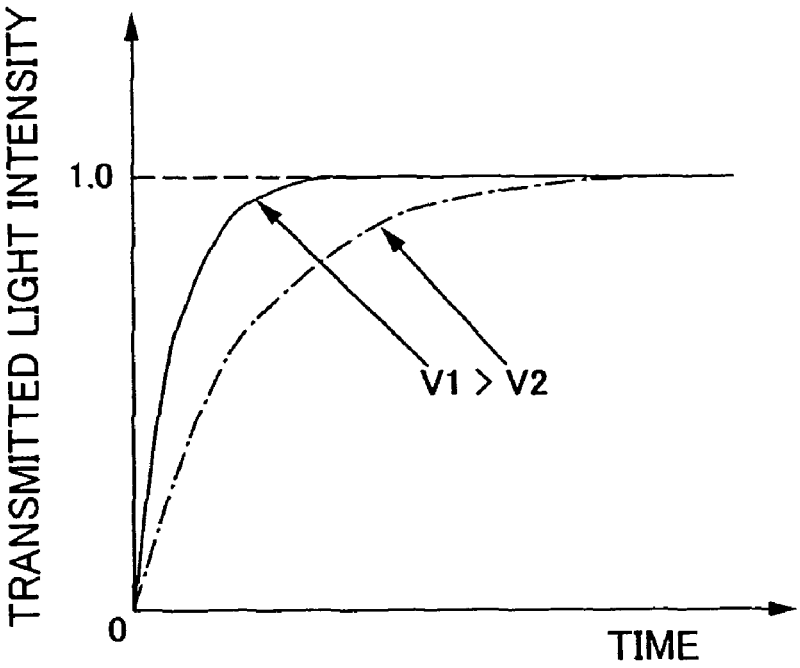
FIG. 6 shows change in rise time by the increase and decrease in the applied voltage.

FIG. 6 shows respective transmitted light intensities in the case where the voltages V1 and V2 (V1>V2) are applied respectively. The rise time $\tau_{ON}$ of the liquid crystal display device in the case where the voltages V1 and V2 (V1>V2) are respectively applied has a characteristic that the rise time is shorter when the higher voltage V1 is applied as shown in FIG. 6. Further, this characteristic is the same in the case of a pulse voltage having a shorter period with respect to the rise time; thus, $\tau_{ON}$ becomes shorter when the applied voltage of the pulse application voltage is higher.

Figure 17:
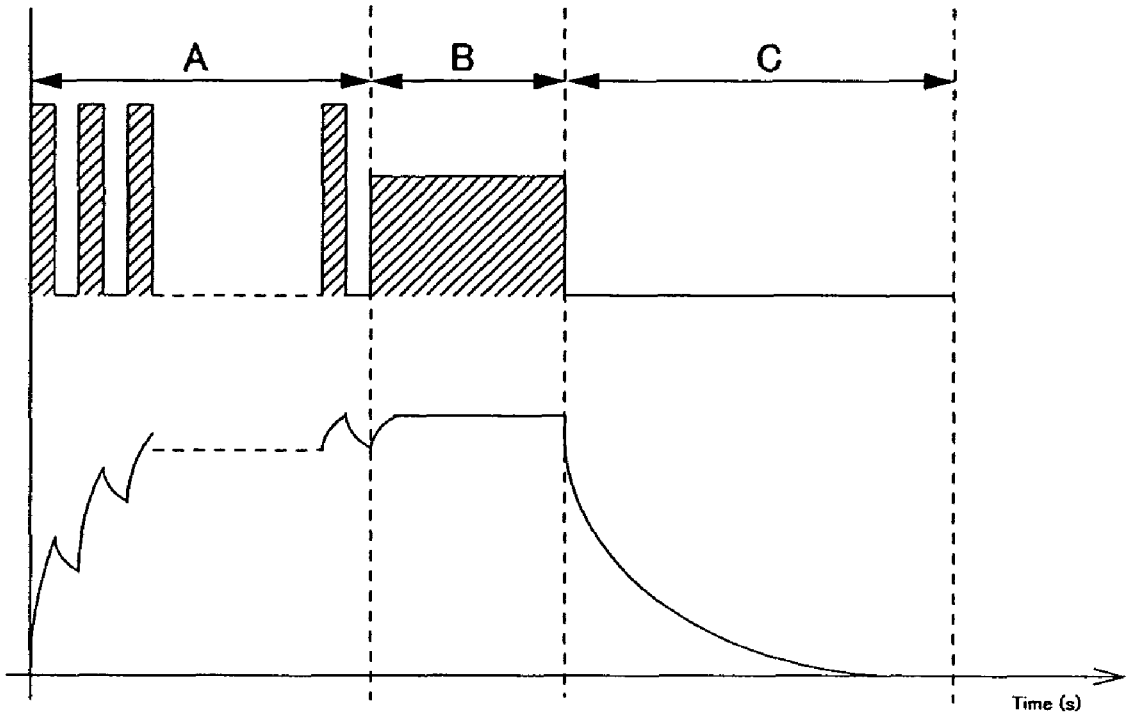
FIG. 17 shows a voltage application waveform and a transient response characteristic of transmitted light intensity of a liquid crystal display device in the present invention.

FIG. 17 shows a voltage application waveform and the transmitted light intensity of a liquid crystal display device according to the present invention. The pulse width of one pulse in a high voltage application period A is shorter than $\tau_{ON}$; accordingly, transmitted light intensity for a desired gray-scale is not achieved. However, since the time before the next pulse is applied is much shorter than $\tau_{OFF}$, the next pulse is applied before the transmitted light intensity of the liquid crystal recovers OFF state even when the applied voltage is temporally OFF. By successively conducting the pulse application, a desired gray-scale can be obtained with transmitted light intensity of a liquid crystal display device. Further, the desired gray-scale obtained in the period A is kept in a period B within which a constant voltage is applied; subsequently, the transmitted light intensity is returned back to an OFF state. Consequently, the response waveform of the liquid crystal element becomes an impulse type, and blur of moving images is reduced.

A liquid crystal display device using a conventional active matrix driving method has slow response speed; therefore, hold type driving, in which an applied voltage is kept until the next data is written, is conducted. In the hold type driving, a desired gray-scale cannot be obtained immediately after the next data is written, which cause blur. On the other hand, in the case of the applied voltage waveform in the present invention has faster response speed; thus, a no-voltage application period can be provided at the end. Further, a black display period can be inserted in the no-voltage application period before the next data is written. Accordingly, the transmitted light intensity characteristics can be an impulse type instead of a hold type. Consequently, blur of moving images can be reduced.

Embodiment Mode 2

In this embodiment mode, a specific voltage application waveform of the present invention will be described in comparison with a voltage application waveform used for a conventional active matrix driving method.

Figures 2A, 2B:
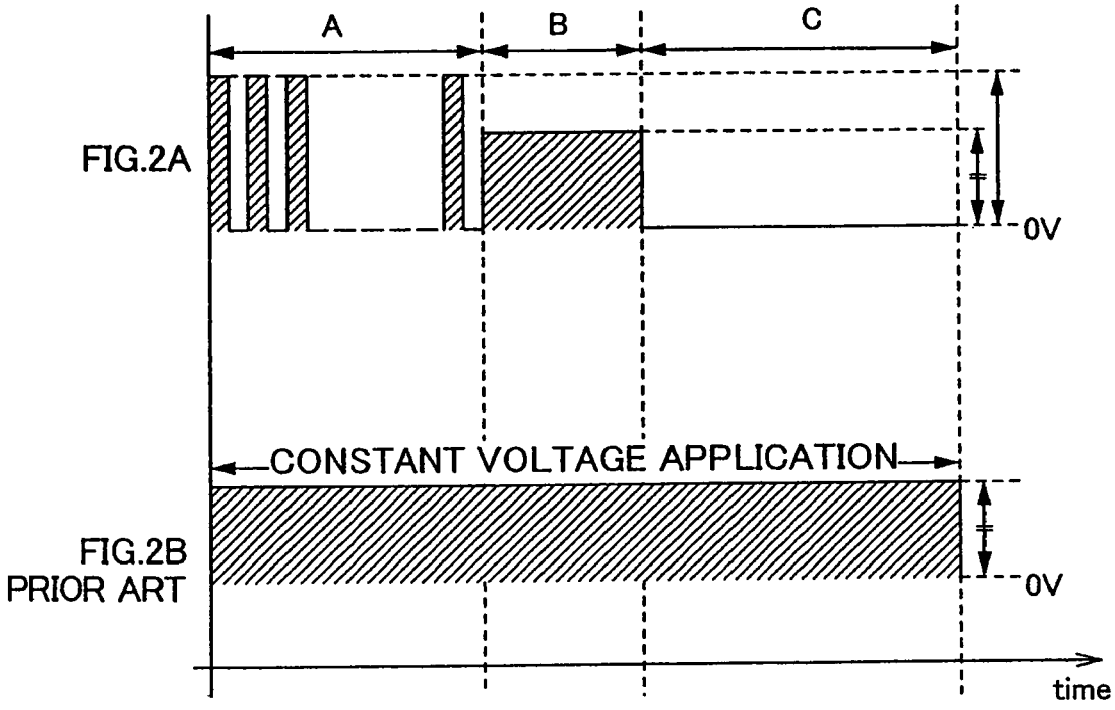
FIG.2B PRIOR ART
FIGS. 2A and 2B show a voltage application waveform for a liquid crystal display device in the present invention and a voltage application waveform for a conventional method.

In a voltage application waveform used for a conventional active matrix driving method, which is shown in FIG. 2B, one pulse per one frame is applied throughout the frame period at a voltage value corresponding to a desired gray-scale for display (reference voltage). On the other hand, in a voltage application waveform for a liquid crystal display device of the present invention, which is shown in FIG. 2A, a plurality of pulses having a frequency shorter than $\tau_{ON}$ are included in a period A provided in the initial stage. Further, the applied voltage is higher than the reference voltage, and the application time in the period is about $\tau_{ON}$ at the longest, namely, as long as $\tau_{ON}$. The period A shall be a high voltage application period. Further, a middle stage, a period B shall be a constant voltage application period within which a reference voltage corresponding to a desired gray-scale is applied. Further, a period C at the end shall be a no-voltage application period. The application time in the period is about $\tau_{OFF}$ at the longest, namely, as long as $\tau_{OFF}$. Note that the applied voltage shown in FIG. 2B is the same as the applied voltage in the period B of FIG. 2A.

The period A in the voltage application time in FIG. 2A is to be $\tau_{ON}$ at the longest, and the period C to be $\tau_{OFF}$. Specific voltage application waveform can be referred to FIG. 1A. Further, the frequency of the application time in the frame period including the periods A to C corresponds to a frame frequency. Accordingly, when a liquid crystal display device is driven with a frame frequency of X Hz, a frame frequency of this embodiment mode is also X Hz, and the frame period is 1/X sec.

By using such a driving method for driving a liquid crystal display device, the transmitted light intensity characteristics can be an impulse type; thus, blur of moving images can be reduced. Further, in that case, the voltage application waveform and the application method according to the present invention can be obtained by increasing the frame frequency from that of a conventional active matrix driving method. Therefore, the circuit is not complicated.

Embodiment Mode 3

In this embodiment mode, a voltage application waveform different from the above embodiment modes will be described.

In a liquid crystal display device using TN liquid crystal, the transmitted light intensity is determined by the absolute value of an applied voltage independently of the polarity. Therefore, the polarity of the applied voltage of a period A is opposite to that of a period B in FIG. 2A. The specific voltage application waveform can be referred to FIG. 1B.

Thus, deflection of a residual ion inside the liquid crystal display device, and the reduction in contrast due to the deflection of a residual ion can be reduced in addition to the effect of the above embodiment modes.

Embodiment Mode 4

In this embodiment mode, a voltage application waveform different from the above embodiment modes will be described.

Different from the above Embodiment Mode 1, the polarity of the voltages applied in the period A is alternately opposite to that of the period B. The specific voltage application waveform can be referred to FIG. 1C.

Thus, deflection of a residual ion inside the liquid crystal display device, and the reduction in contrast due to the deflection of a residual ion can be reduced in addition to the effect of the above embodiment modes.

Embodiment Mode 5

In this embodiment mode, a voltage application waveform different from the above embodiment modes will be described.

Short frequency pulses in a voltage application waveform in the present invention are applied to improve $\tau_{ON}$ by applying high voltage at the beginning of pulse application. Accordingly, the absolute value of the applied voltage is not required to be always constant, and it can changed in the period A, for example, reduce gradually, increase gradually, and varies one by one. The specific voltage application waveform can be referred to FIG. 1D.

Embodiment Mode 6

In this embodiment mode, a voltage application waveform different from the above embodiment modes will be described.

Different from the above Embodiment Mode 1, voltage having polarity opposite to that of the period B is applied in no-voltage application part of the period A. The specific voltage application waveform can be referred to FIG. 1E.

Thus, deflection of a residual ion inside the liquid crystal display device, and the reduction in contrast due to the deflection of a residual ion can be reduced in addition to the effect of the above embodiment modes.

Further, no-voltage application part is not included in the period A; thus, high response speed can be achieved.

Embodiment Mode 7

In this embodiment mode, a structure of a liquid crystal display device will be described.

Figure 7:
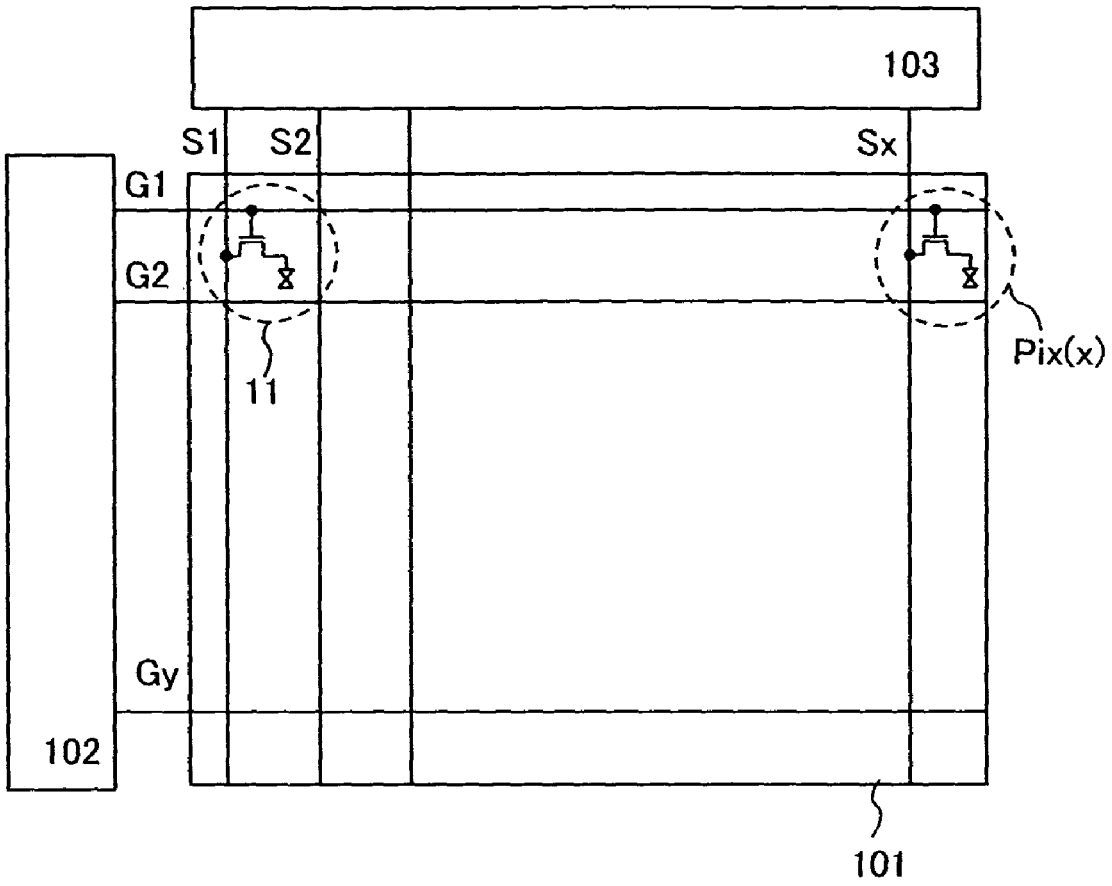
FIG. 7 shows a structure of a liquid crystal display device in the present invention.

FIG. 7 is a structural figure of a liquid crystal display device of the present invention. The liquid crystal display device includes an active matrix liquid crystal panel 101, a gate line driver circuit 102 for driving a gate line of the panel, and a source line driver circuit 103 for driving a source line of the panel.

A signal for turning a switching transistor ON is inputted from the gate line driver circuit 102 into a gate line 1 (G1). Subsequently, a video signal is inputted from a source line 1 (S1) into a source line x (Sx) from the source line driver circuit 103, so that a voltage corresponding to the video signal is applied to a pixel x (Pix (x)) from a pixel 11 of the active matrix liquid crystal panel. The series of operation is repeated to a gate line y (Gy). When 1/n second is required to scan from the gate line 1 (G1) to the gate line y (Gy) once for each, the frame frequency is n Hz. The method in which each pixel connected to one gate line is thus driven is referred to as a line sequential driving.

In the present invention, when the width of one pulse (pulse width) in plural pulse application part is 1/m sec, the driving is conducted with the frame frequency of m Hz.

Further, as described in Embodiment Mode 1, the subframe period 1/m is shorter than $\tau_{ON}$. In a conventional active matrix driving method, one image is displayed with one frame. On the other hand, in the case of employing the present invention, a desired image is not displayed with a frequency of the conventional one frame. In the present invention, a method in which one image is displayed in a frame period including a plurality of (here, the number is assumed to be a) subframes each having the frequency of 1/m can be employed. The frame period including a plurality of subframes corresponds to the voltage application waveform shown in FIG. 1A to 1E. Accordingly, the time required for displaying one image, that is, the frame period is a/m sec. Further, a frame frequency indicates the number of displayed images per one second, and a substantial frame frequency of the present invention is m/a Hz.

As for the above driving method, the frame frequency is simply increased compared with a conventional active matrix driver circuit. Therefore, there are no major changes in the liquid crystal display device structure, and the driving can be carried out without complexity of the circuit configuration.

However, a circuit in the gate line driver circuit or the source line driver circuit has a function of applying high voltage to a liquid crystal element and a function of applying a constant voltage after the high voltage application. These functions may be integrated on a glass substrate where a pixel area is formed, or may be mounted on a printed substrate. A circuit in the gate line driver circuit or the source line driver circuit further has a function of applying a voltage that is lower than the absolute value of the threshold voltage or a function of controlling so as not to apply any voltage.

In such a liquid crystal display device, the voltage application waveform shown in Embodiment Mode 2 is applied, and the driving can be conducted with the period A: 3 ms, the period B: 3 ms, and the period C: 9 ms, for example.

Note that a driving method of the present invention can be applied to a point sequential driving for independently driving each pixel, in which a video signal is sequentially inputted to one source line when an ON signal is inputted to the gate line 1 (G1).

Embodiment Mode 8

In this embodiment mode, a cellular phone using a liquid crystal display device of the present invention will be described.

Figure 10:
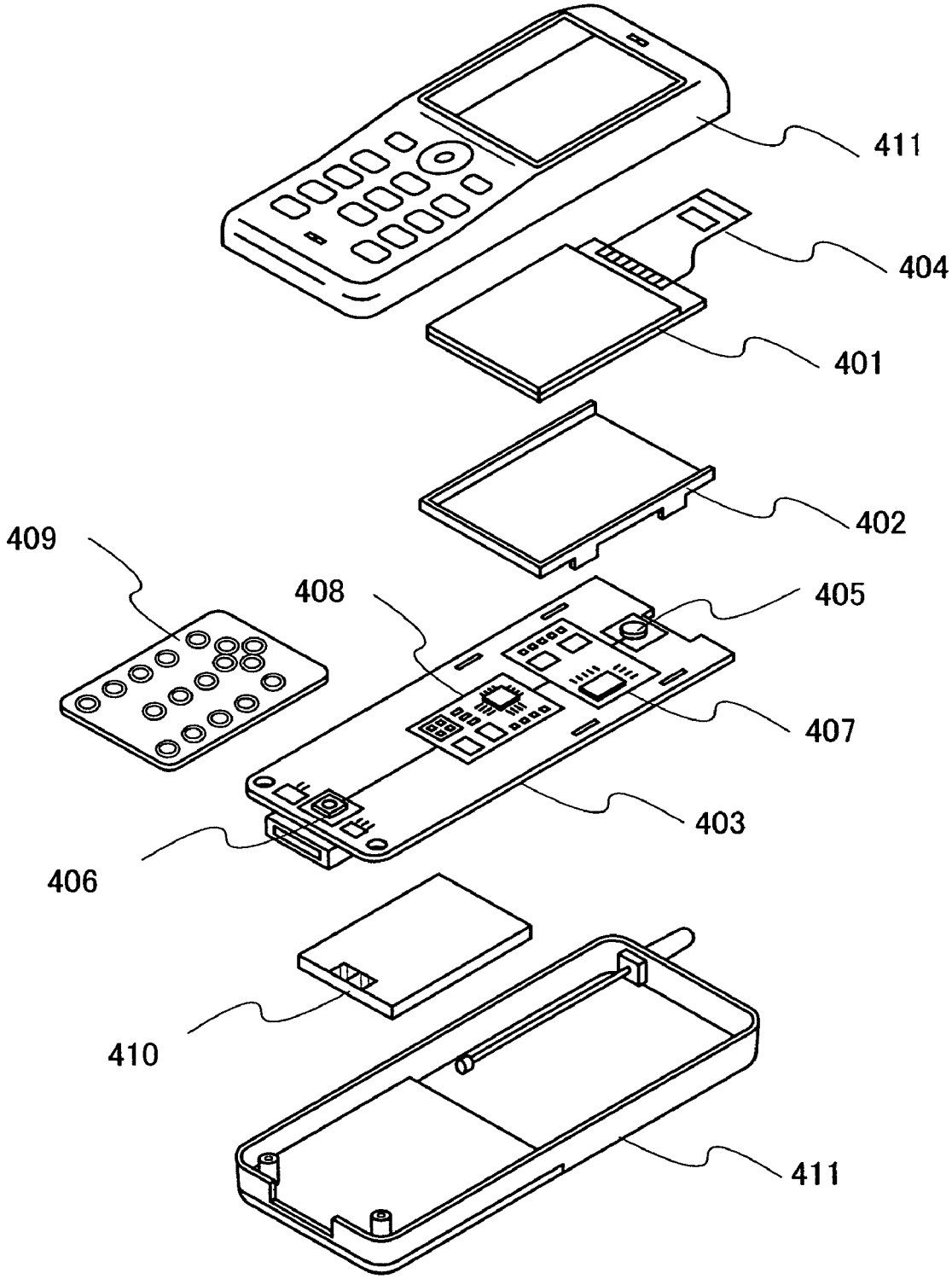
FIG. 10 shows a cellular phone using a liquid crystal display device of the present invention.

FIG. 10 shows one example of a cellular phone using a liquid crystal display device according to the present invention. A display panel 401 equivalent to a liquid crystal display device of the present invention is detachably incorporated in a housing 402. The shape and the size of the housing 402 can be determined appropriately in accordance with the size of the display panel 401. The housing 402, in which the display panel 401 is fixed, is attached to a printed substrate 403, so as to fabricate a module.

The display panel 401 is connected to the printed substrate 403 through an FPC 404. Over the printed substrate 403, a signal processing circuit 408 is provided, which includes a speaker 405, a microphone 406, a transmit/receive circuit 407, a CPU, a controller and the like. The module, an input means 409, and a battery 410 are combined and stored in a frame 411. A pixel portion of the display panel 401 is placed so as to be seen through an aperture window that is formed in the frame 411.

The display panel is driven using the voltage application waveform as described in the above embodiment mode to improve the response speed. Further, a driving method using a voltage application waveform according to the present invention can be achieved by increasing the frame frequency; thus, the circuits to be provided on the printed substrate 403 or the like are not complicated. Therefore, the miniaturization and light weight of the cellular phone can be achieved.

The cellular phone in accordance with this embodiment mode can be changed into various modes depending on the function or the usage thereof. For example, even when the cellular phone has a plurality of display panels or has a hinged open and shut structure in which a frame is appropriately separated into a plurality of frames, the advantages described above can be obtained.

Embodiment Mode 9

The following can be given as an example of an electronic device using a liquid crystal display device of the present invention other than the above cellular phone: a television apparatus (also simply referred to as a television or a television receiver), a camera such as a digital camera or a digital video camera, a portable information terminal such as PDA, a portable game machine, a computer monitor, a computer, an audio reproducing device such as a car audio, an image reproducing device provided with a recording medium, such as a home game machine, or the like. The specific examples will be explained with reference to FIGS. 11A to 11E.

Figure 11A:
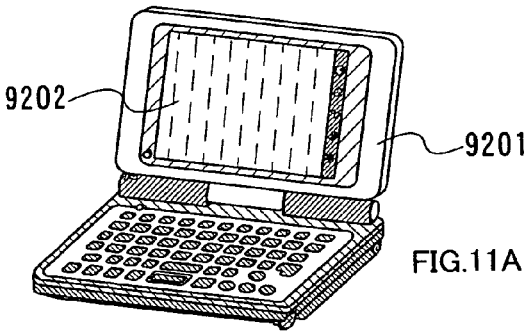
FIGS. 11A to 11E show examples of electronic devices using a liquid crystal display device of the present invention.

A personal digital assistant device shown in FIG. 11A includes a main body 9201, a display area 9202, and the like. The liquid crystal display device of the present invention can be applied to the display area 9202. Consequently, a high-speed response personal digital assistant device can be provided without the complexity of circuitry.

Figure 11B:
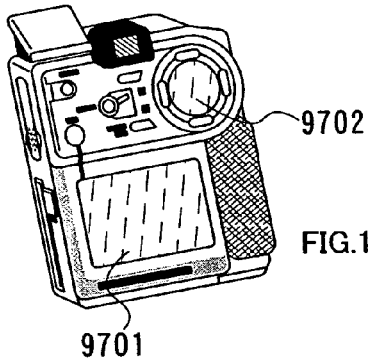

A digital video camera shown in FIG. 11B includes a display area 9701, a display area 9702, and the like. The liquid crystal display device of the present invention can be applied to the display area 9701. Consequently, a high-speed response digital video camera can be provided without the complexity of circuitry.

Figure 11C:
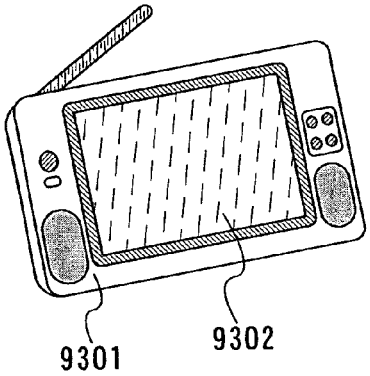

A portable television apparatus shown in FIG. 11C includes a main body 9301, a display area 9302, and the like. The liquid crystal display device of the present invention can be applied to the display area 9302. Consequently, a high-speed response portable television apparatus can be provided without the complexity of circuitry. In addition, as for a television apparatus, the liquid crystal display device of the present invention can be widely applied to a small-sized television to be mounted on a portable terminal such as a cellular phone, a portable middle-sized television, a large-sized television (for example, 40 inch or more), and the like.

Figure 11D:
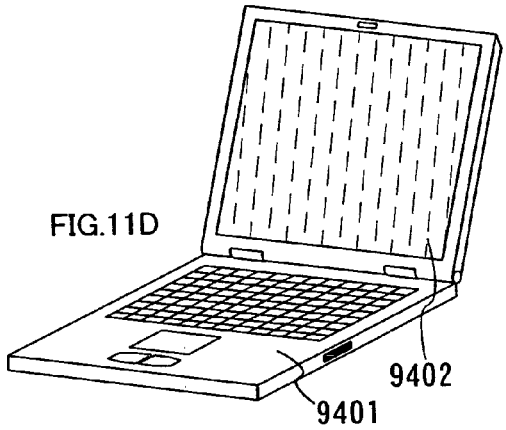

A portable computer shown in FIG. 11D includes a main body 9401, a display area 9402, and the like. The liquid crystal display device of the present invention can be applied to the display area 9402. Consequently, a high-speed response portable computer can be provided without the complexity of circuitry.

Figure 11E:
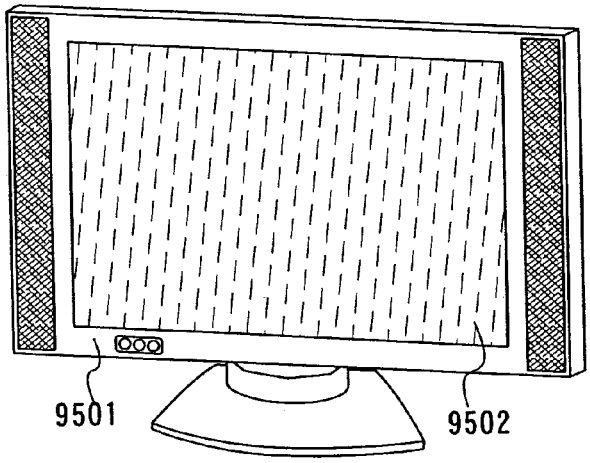

A television apparatus shown in FIG. 11E includes a main body 9501, a display area 9502, and the like. The liquid crystal display device of the present invention can be applied to the display area 9502. Consequently, a high-speed response television apparatus can be provided without the complexity of circuitry.

Thus, high-speed response electronic devices can be provided without the complexity of circuitry using a liquid crystal display device of the present invention.

Embodiment Mode 10

In this embodiment mode, a rear-projection display device using a liquid crystal display device of the present invention will be described.

Figure 12A:
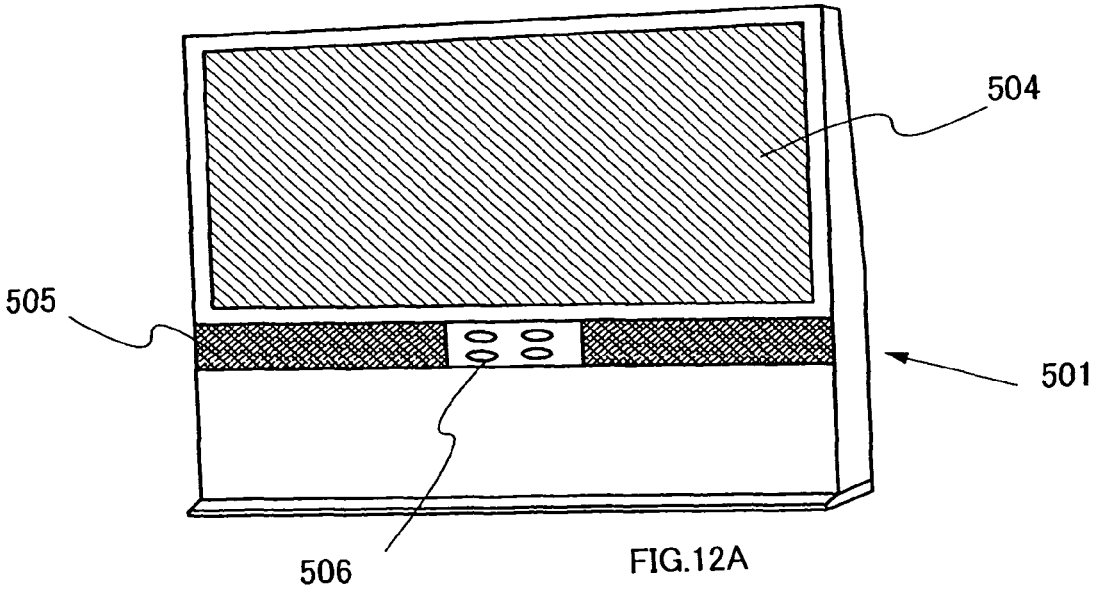
FIGS. 12A and 12B show a rear-projection display device using a liquid crystal display device of the present invention.

A rear-projection display device 501 shown in a general view of FIG. 12A and a cross-sectional view of 12B includes a projector unit 502, a mirror 503 and a screen panel 504. In addition, a speaker 505 and operation switches 506 may also be provided. The projector unit 502 is placed in a lower position of a frame 507 of the rear-projection display device 501, and projects light for displaying an image toward the mirror 503, based on an image signal. The rear-projection display device 501 displays an image that is projected from the backside of the screen panel 504.

Figure 13:
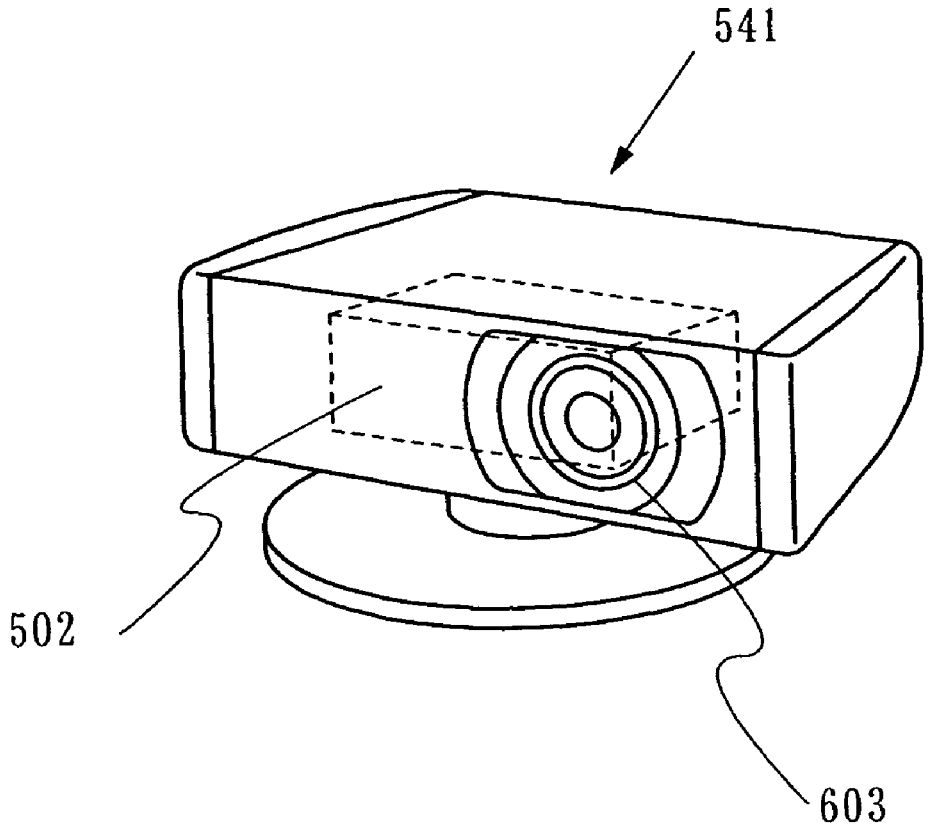
FIG. 13 shows a front-projection display device using a liquid crystal display device of the present invention.

Meanwhile, FIG. 13 shows a front-projection display device 541. The front-projection display device 541 includes a projector unit 502 and a projection optical system 603. The front-projection display device 541 projects an image on a screen or the like placed in front.

The structures of projector units 502 that are applied to the rear-projection display device 501 shown in FIGS. 12A and 12B and the front-projection display device 541 shown in FIG. 13 will be described below.

Figure 14:
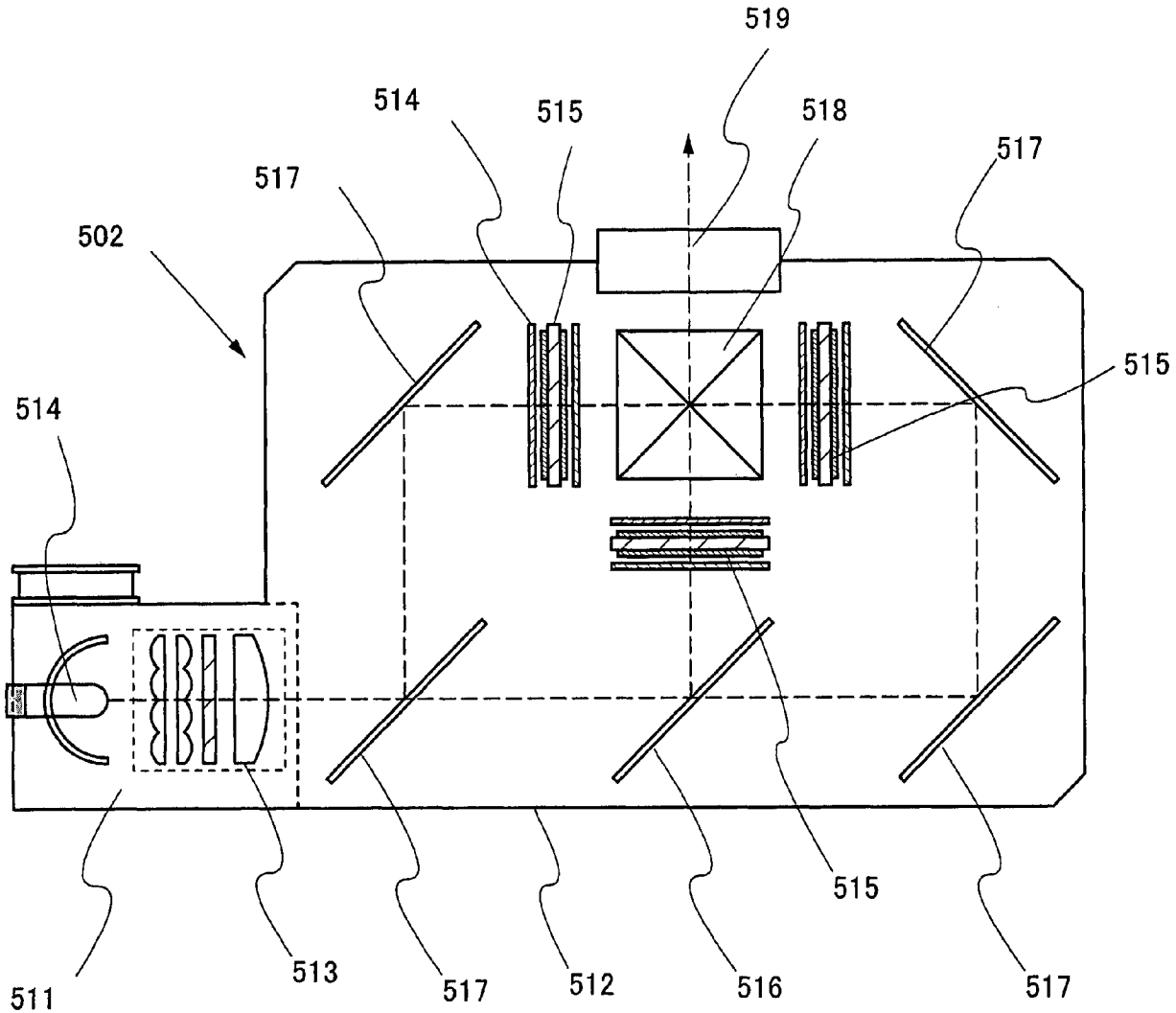
FIG. 14 shows a projector unit using a liquid crystal display device of the present invention.

FIG. 14 shows one structural example of a projector unit 502. The projector unit 502 includes a light source unit 511 and a modulation unit 512. The light source unit 511 includes a light source optical system 513 having lenses and a light source lamp 514. The light source lamp 514 is stored in a frame not to diffuse stray light. As the light source lamp 514, for example, a high pressure mercury lamp, a xenon lamp or the like is used, which is capable of emitting a large amount of light. The light source optical system 513 is composed by appropriately providing an optical lens, a film that has a polarizing function, a film for controlling phase difference, an IR film, and the like. The light source unit 511 is placed so that emitted light enters the modulation unit 512. The modulation unit 512 includes a plurality of liquid crystal panels 515, a color filter provided on or in the vicinity of the panel, dichroic mirrors 516, total reflection mirrors 517 provided at plural comers, a prism 518, and a projection optical system 519. Light emitted from the light source lamp 514 is divided into a plurality of light paths by the dichroic mirrors 516.

Each light path is provided with a liquid crystal panel 515 transmitting light of a predetermined wavelength or wavelength range and a color filter provided on or in the vicinity of the crystal panel 515, a phase difference plate 540 provided outside the color filter. Such a liquid crystal panel, which is transmits light includes a pixel electrode formed of a transparent electrode material such as ITO. The transmissive liquid crystal panel 515 modulates transmitted light based on an image signal. Light of each color transmitted by the liquid crystal panel 515 enters the prism 518 and displays an image on a screen panel 504 through a lens of the projection optical system 519. In the case of a rear-projection display device 501, a fresnel lens is provided between the mirror 503 and the screen panel 504. The projection light that is projected by the projector unit 502 and reflected by the mirror 503 is converted to almost parallel light by this fresnel lens and projected on the screen panel 504.

A liquid crystal display device using a driving method according to the present invention can be applied to the liquid crystal panel 515. Consequently, blur of moving images can be reduced. In that case, a driving method using a voltage application waveform according to the present invention can be achieved by increasing the frame frequency from that of a conventional active matrix driving method. Therefore, the circuitry is not complicated, which is preferable.

Figure 15:
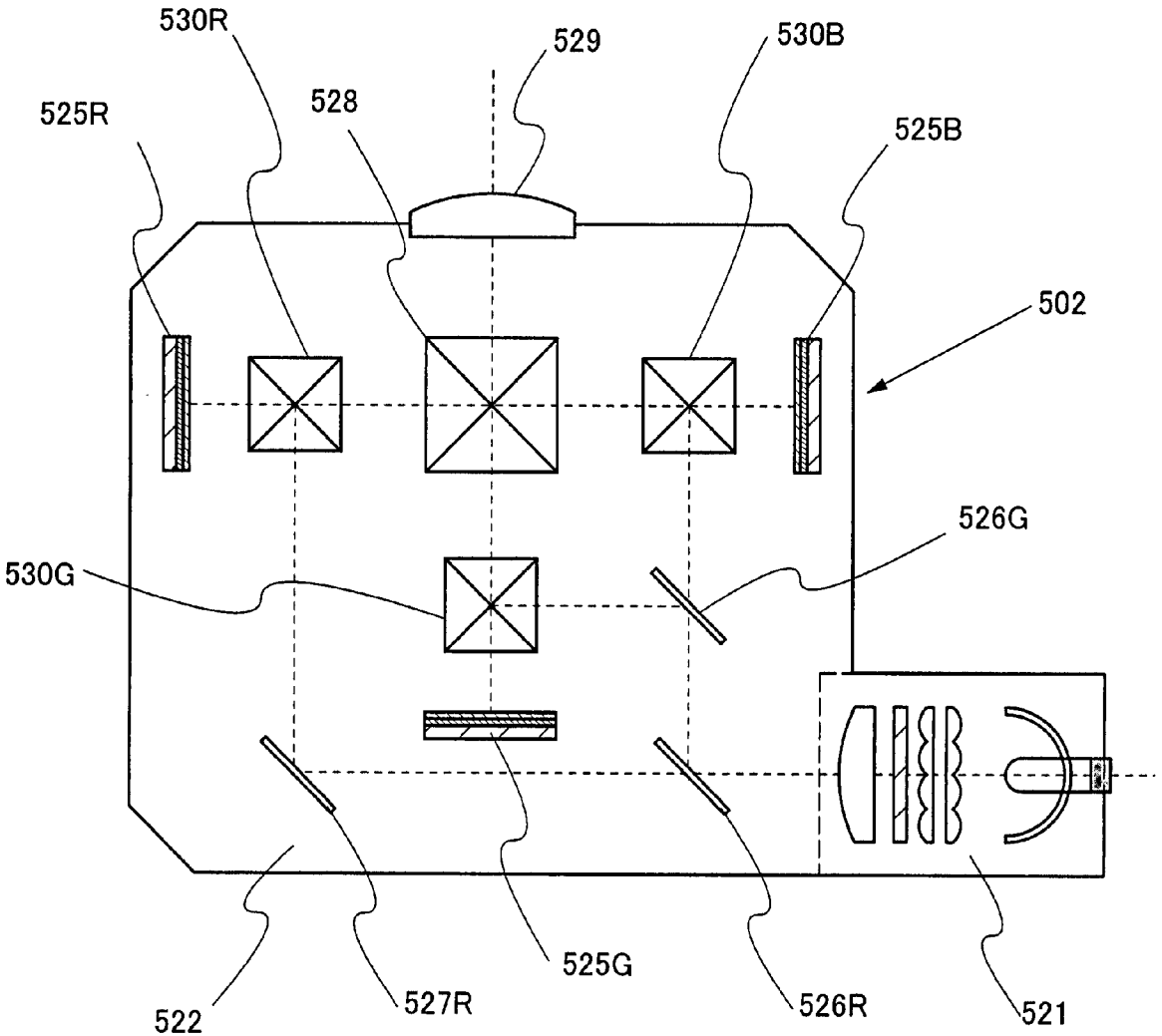
FIG. 15 shows a projector unit using a liquid crystal display device of the present invention.

A projector unit 502 shown in FIG. 15 has a structure which is provided with reflective liquid crystal panels 525R, 525Q and 525B. The reflective liquid crystal panels 525R, 525C; and 525B each have a structure in which the pixel electrode is formed using aluminum (Al), Ti (titanium), an alloy of those metals, or the like.

The projector unit 502 includes a light source unit 521 and a modulation unit 522. The light source unit 521 has the same structure as in FIG. 14. Light from the light source unit 521 is divided into a plurality of light paths by dichroic mirrors 526R and 526G and a total reflection mirror 527R, and enters polarizing beam splitter 530R, 530Q and 530B. The polarizing beam splitter 530R, 530Q and 530B are provided with respect to the reflective liquid crystal panels 525R, 525G, and 525B corresponding to each color. The reflective liquid crystal panels 525R, 525G, and 525B modulate transmitted light based on an image signal. Light of each color that is reflected by the reflective liquid crystal panels 525R, 525Q and 525B enters a prism 528, and is projected through a lens of a projection optical system 529.

Of light that is emitted from the light source unit 521, only light of a red wavelength range is transmitted through the dichroic mirror 526R, and light of a green or blue wavelength range is reflected by the dichroic mirror 526R. Further, only light of a green wavelength range is reflected by the dichroic mirror 526G. The light of a red wavelength range, which has been transmitted through the dichroic mirror 526R, is reflected by the total reflection mirror 527R, and enters the polarizing beam splitter 530R. The light of a green wavelength range enters the polarizing beam splitter 530G, and the light of a blue wavelength range enters the polarizing beam splitter 530B. The polarizing beam splitters 530R, 530G, and 530B each have a function of splitting incident light into P-polarized light and S-polarized light, and a function of transmitting only the P-polarized light. The reflective liquid crystal panels 525R, 525G, and 525B polarize light incident from the polarizing beam splitters based on an image signal.

Only the S-polarized light corresponding to each color enters the reflective liquid crystal panels 525R, 525G, and 525B corresponding to each color. The reflective liquid crystal panels 525R, 525G, and 525B can be operated in an electrically controlled birefringence mode (ECB). Since a liquid crystal molecule is orientated perpendicularly at an angle to a substrate. Therefore, in the reflective liquid crystal panels 525R, 525C, and 525B, incident light is reflected with no change in the polarizing state when a pixel is in an OFF state. When a pixel is in an ON state, the orientation state of the liquid crystal molecule is changed and the polarizing state of incident light is changed to reflect the incident light.

Figure 12B:
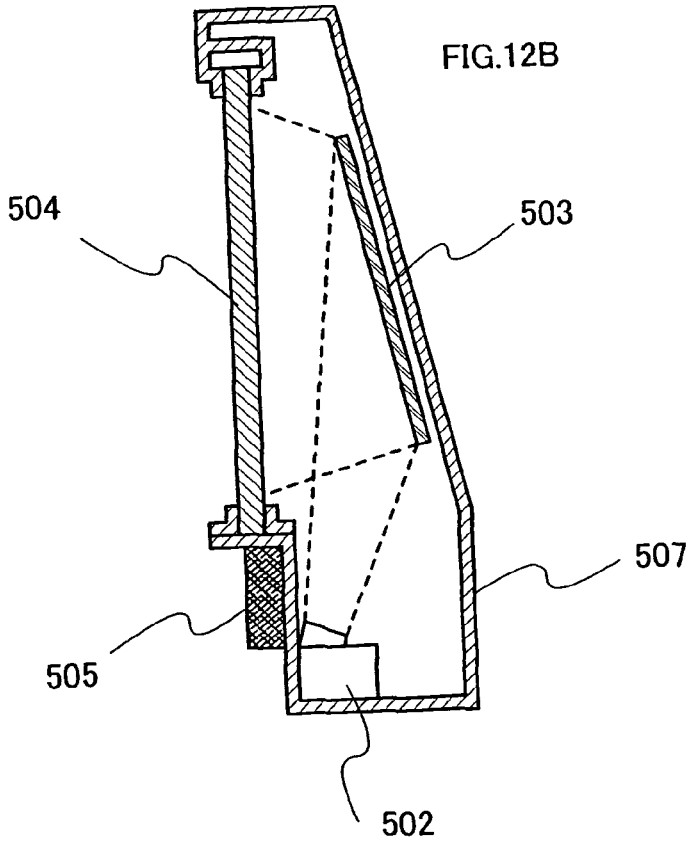

The projector unit 502 shown in FIG. 15 can be applied to the rear-projection display device 501 shown in FIGS. 12A and 12B and the front-projection display device 541 shown in FIG. 13.

Figure 16A:
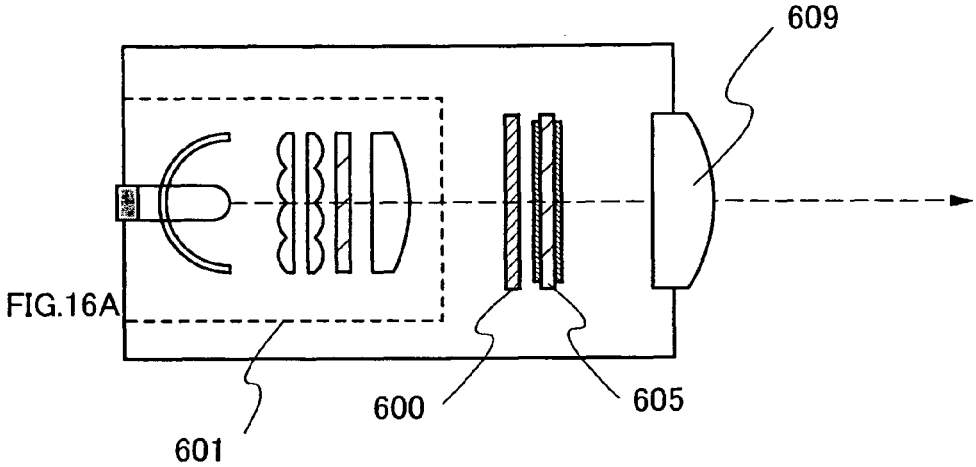
FIGS. 16A to 16C show projector units using a liquid crystal display device of the present invention.
Figure 16B:
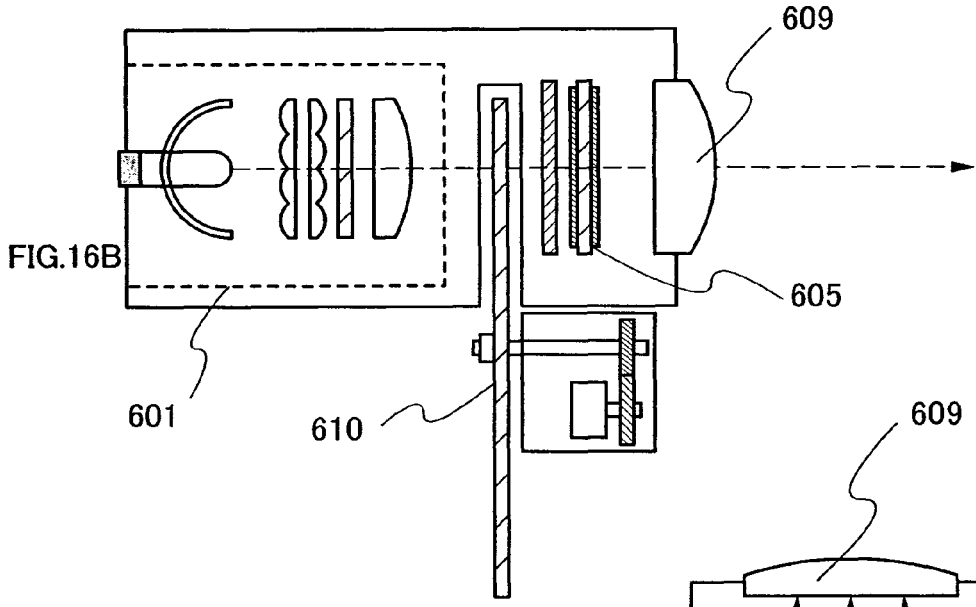
Figure 16C:
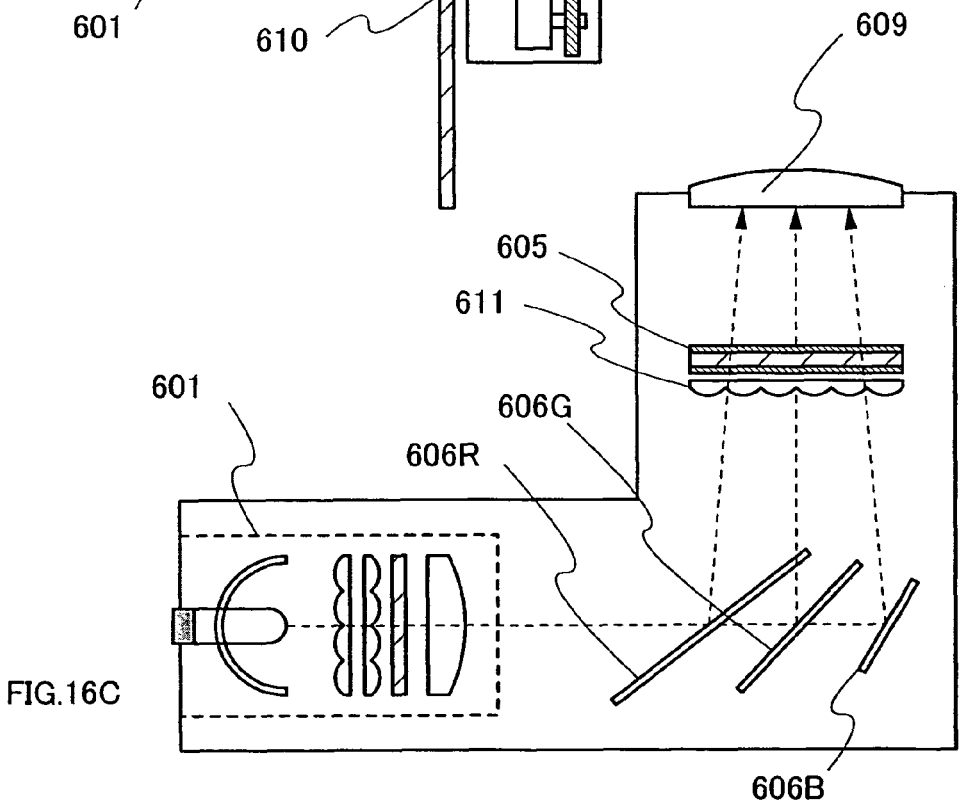

Next, structures different from the projector unit will be described. FIG. 16A to 16C show single-plate projector units. The projector unit 502 shown in FIG. 16A includes a light source unit 601, a liquid crystal panel 605, a projection optical system 609, and a phase difference plate 600. The projection optical system 609 includes one or a plurality of lenses. Further, the projector unit 502 is provided with a color filter provided on or in the vicinity of the liquid crystal panel 605. Note that a single-plate mode includes a field sequential mode in which one liquid crystal display device is temporally divided into three periods of an R period, a G period, and a B period; and a color filter method in which one pixel of one liquid crystal display device is divided into regions of three colors of RGB. The former field sequential method is applied in this embodiment mode.

FIG. 16B shows the structure of a projector unit 502 which operates in a field sequential mode. The field sequential mode is a mode in which light of each color such as red, green, or blue is made enter a liquid crystal panel sequentially with a time lag, and color display is conducted without a color filter. In particular, when the field sequential mode and a fast-response liquid crystal panel are combined, high-definition images can be displayed. In FIG. 16B, a rotary color filter plate 610 provided with a plurality of color filters for red, green and blue is provided between a light source unit 601 and a liquid crystal panel 605.

A projector unit 502 shown in FIG. 16C has a structure of a color separation system that uses a micro lens for a color display method. In this method, a micro lens array 611 is provided on a light incidence side of a liquid crystal panel 605, and light of each color is illuminated from each direction to achieve color display. In a projector unit 502 that uses this method, no light is lost due to a color filter; thus, the projector unit 502 has a feature that light from the light source unit 601 can be used effectively. The projector unit 502 includes a dichroic mirror 606R for R, a dichroic mirror 606G for G and a dichroic mirror 606B for B so that light of each color is illuminated from each direction to the liquid crystal panel 605.

A liquid crystal display device employing a driving method of the present invention can be applied to the liquid crystal panel 605. As a result, blur of moving images can be reduced in a display device including a single-plate projector unit. Further, in that case, a voltage application waveform in accordance with the present invention and a driving method using the voltage application waveform can be obtained by increase frame frequency of a conventional active matrix driving method; thus, a circuit can be prevented from being complicated, which is preferable.

Thus, according to the present invention, a projection display device (projection television apparatus) in which blur of moving images can be reduced can be provided without the complexity of a circuit.

Embodiment

Figures 8A, 8B:
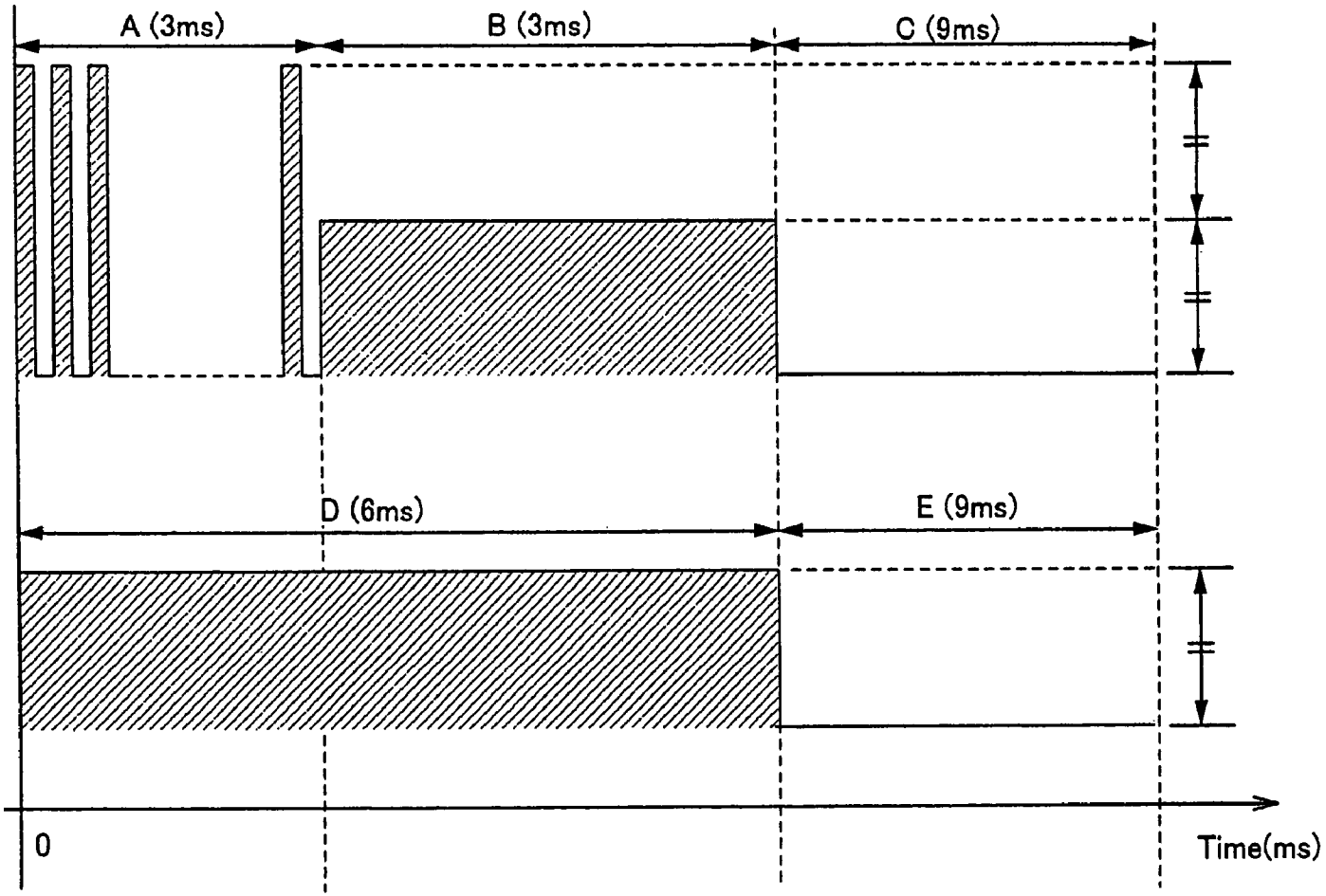
FIG.8B PRIOR ART
FIGS. 8A and 8B each show a voltage application waveform in the present invention.

In this embodiment, normally white display is conducted with polarizers arranged as crossed nichols using a TN liquid crystal display device. As shown in FIG. 8A, one frame is 15 msec, the initial period is 3 msec, the duty ratio is 50%, and the pulse has a period of 0.1 msec. Accordingly, the subframe is 0.05 msec. A constant voltage application period of 3 msec is provided thereafter, and the value of the constant voltage is to be the reference voltage corresponding to a display gray-scale. The applied voltage of the first half is to be twice the applied voltage of the last half Further, no voltage is applied in the remaining 9 msec.

The response characteristics of the transmitted light intensity of the above voltage application waveform is compared with a conventional voltage application waveform shown in FIG. 8B, in which the initial period (period D) of 6 msec is to be a voltage application period, a reference voltage equivalent to a period B of FIG. 8A, that is a voltage at which the applied voltage of the period B of FIG. 8A is equal to the applied voltage of FIG. 8B is applied.

Figure 9:
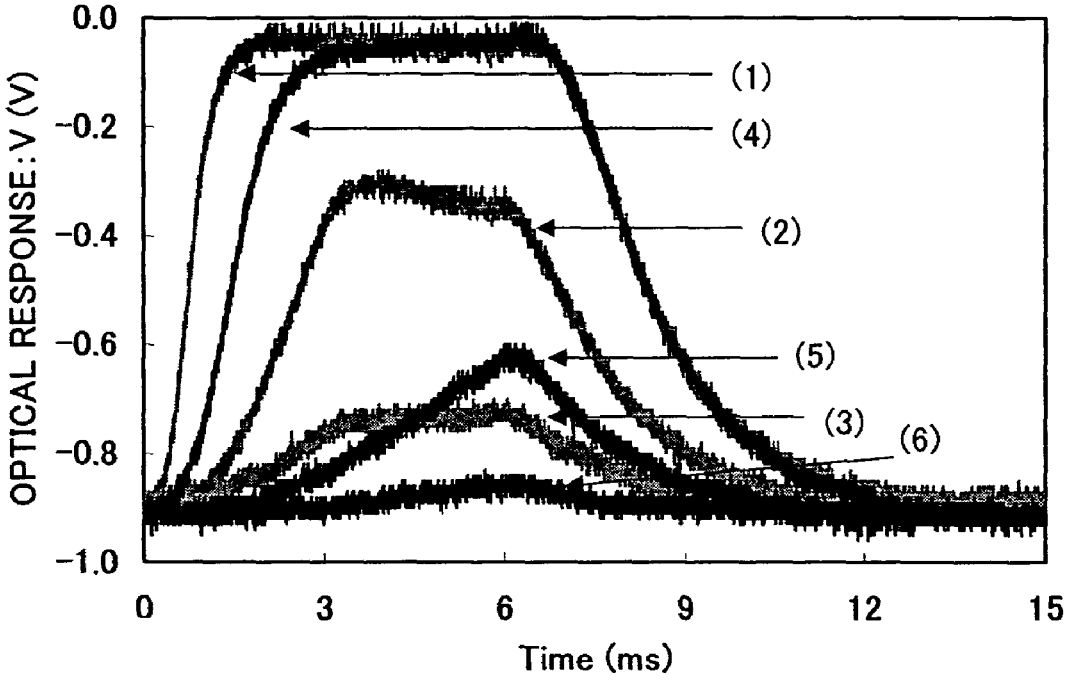
FIG. 9 shows transient response characteristics of transmitted light intensity of a liquid crystal display device in the embodiment.

The result is shown in FIG. 9. The transient response characteristics of the transmitted light intensity of the voltage application waveform shown in FIG. 8A is shown in (1) to (3). In (1), the voltage of the period A is 8 V and the voltage of the period B is 4 V. In (2), the voltage period A is 4.5 V and the voltage of the period B is 2.25 V. In (3), the voltage period A is 3.5 V and the voltage of the period B is 1.75 V. The response characteristics of the transmitted light intensity of the voltage application waveform shown in FIG. 8B equivalent to the reference voltage are shown in (4) to (6). In (4), the voltage of the period D is 4 V. In (5), the voltage of the period D is 2.25 V. In (6), the voltage of the period D is 1.75 V.

In (1) to (3), $\tau_{ON}$ is improved. This is because a voltage higher than (4) to (6) is applied at the beginning of the initial period of voltage application, and $\tau_{ON}$ is influenced by the voltage.

On the other hand, when the conventional voltage application waveform shown in FIG. 8B is applied, $\tau_{ON}$ is slow, and it is difficult to display multiple gray scales within 15 ms.

In FIG. 8A in accordance with the present invention as above, $\tau_{ON}$ is fast in halftones as shown in (2) and (3) of FIG. 9A, so that multiple gray scales can easily be displayed within 15 ms. On the other hand, when the voltage application waveform of a conventional active matrix driving method, which is shown in FIG. 8B, is applied, change in the transmitted light intensity is small; thus, it is extremely difficult to display multiple gray scales.

The above result shows that the voltage application waveform shown in FIG. 8A is effective for high-speed response of a liquid crystal display device.

Further, from the above result, since higher speed response is achieved with the voltage application waveform using the present invention, it is found that the reproducibility of multiple gray scales within 15 msec can be obtained and the transmitted light intensity characteristics of an impulse type can be obtained by providing a no-voltage application period. Consequently, the voltage application waveform of the present invention is used for a normally black liquid crystal display device having polarizers arranged as parallel nichols; thus, black display can be inserted between each frame period and the next frame period, which can reduce blur of moving images.

What is claimed is:

1. A method for driving a liquid crystal display device comprising:

providing a liquid crystal element whose incident light transmittance corresponds to an OFF state, applying a plurality of pulses having a first voltage to the liquid crystal element in a first period which is a first part of a frame period, each pulse having a width shorter than a rise time which is a time that the light transmittance of the liquid crystal element takes to change to a gray-scale state when a reference voltage, lower than the first voltage, is applied to the liquid crystal element;

applying a constant non-null second voltage to the liquid crystal element in a second period which is a second part of the frame period, situated after the first period; and applying a third voltage lower than an absolute value of a threshold voltage to the liquid crystal element in a third period which is a third part of the frame period, situated after the second period, wherein the applied pulses are separated from each other by an interval of time substantially equal to the width of the pulses;

wherein an absolute value of the first voltage is higher than the constant non-null second voltage, wherein the incident light transmittance of the liquid crystal element is changed from the OFF state to the gray-scale state in the first period and maintained in the gray-scale state in the second period; and wherein the third period is substantially equal to a fall time defined as a time necessary for the incident light transmittance of the liquid crystal element to change from the gray-scale state to the OFF state when no voltage is applied.

2. A method according to claim 1, wherein the first period is substantially equal to a time that the light transmittance of the liquid crystal element takes to change to the gray-scale state when the plurality of pulses having the first voltage is applied to the liquid crystal element.

3. A method according to claim 1, wherein in the frame period, a black display period is inserted using the third period.

4. A method for driving a liquid crystal display device comprising:

providing a liquid crystal element whose incident light transmittance corresponds to an OFF state, applying a plurality of pulses having a first voltage to the liquid crystal element in a first period which is a first part of a frame period so as to modify the light transmittance in the first period, each pulse having a width shorter than a rise time which is a time that the light transmittance of the liquid crystal element takes to change to a gray-scale state when a reference voltage, lower than the first voltage, is applied to the liquid crystal element;

applying a constant non-null second voltage to the liquid crystal element in a second period which is a second part of the frame period, situated after the first period; and applying a third voltage lower than an absolute value of a threshold voltage to the liquid crystal element in a third period which is a third part of the frame period, situated after the second period, wherein the applied pulses are separated from each other by an interval of time substantially equal to the width of the pulses;

wherein an absolute value of the first voltage is higher than the constant non-null second voltage, wherein the incident light transmittance of the liquid crystal element is changed from the OFF state to the gray-scale state in the first period and maintained in the gray-scale state in the second period, wherein the third period is substantially equal to a fall time defined as a time necessary for the incident light transmittance of the liquid crystal element to change from the gray-scale state to the OFF state when no voltage is applied, and wherein the incident light transmittance of the liquid crystal element corresponds to the OFF state at an end of the frame period.

5. A method for driving a liquid crystal display device comprising:

providing a liquid crystal element whose incident light transmittance indicates an OFF state, applying a plurality of pulses having a first voltage to the liquid crystal element in a first period which is a first part of a frame period, each pulse having a width shorter than a rise time which is a time that the light transmittance of the liquid crystal element takes to change to a gray-scale state when a reference voltage, lower than the first voltage, is applied to the liquid crystal element;

applying a constant non-null second voltage to the liquid crystal element in a second period which is a second part of the frame period, situated after the first period; and applying a third voltage lower than an absolute value of a threshold voltage to the liquid crystal element in a third period which is a third part of the frame period, situated after the second period so that the incident light transmittance of the liquid crystal element corresponds to the OFF state at an end of the third period, wherein the applied pulses are separated from each other by an interval of time substantially equal to the width of the pulses;

wherein the incident light transmittance of the liquid crystal element is changed from the OFF state to the gray-scale state in the first period and maintained in the gray-scale state in the second period, wherein the third period is substantially equal to a fall time defined as a time necessary for the incident light transmittance of the liquid crystal element to change from the gray-scale state to the OFF state when no voltage is applied, and wherein an absolute value of the first voltage is higher than the constant non-null second voltage.

6. A liquid crystal display device comprising:

a plurality of pixels, each pixel comprising a liquid crystal, whose incident light transmittance corresponds to an OFF state, the liquid crystal display device being configured so that:

a plurality of pulses having a first voltage can be applied to the pixel in a first period which is a first part of a frame period so as to modify the light transmittance in the first period, each pulse having a width shorter than a rise time which is a time that the light transmittance of the liquid crystal element takes to change to a gray-scale state when a reference voltage, lower than the first voltage, is applied to the liquid crystal element, a constant non-null second voltage can be applied to the pixel in a second period which is a second part of the frame period, situated after the first period, a third voltage, lower than an absolute value of a threshold voltage, can be applied to the pixel in a third period which is a third part of the frame period, situated after the second period, the pulses can be separated from each other by an interval of time substantially equal to the width of the pulses;

an absolute value of the first voltage can be higher than the constant non-null second voltage, the incident light transmittance of the pixel can be changed from the OFF state to the gray-scale state in the first period and maintained in the gray-scale state in the second period, and the incident light transmittance of the pixel can correspond to the OFF state at an end of the frame period, wherein the third period would be substantially equal to a fall time defined as a time necessary for the incident light transmittance of the liquid crystal element to change from the gray-scale state to the OFF state when no voltage is applied.

7. A liquid crystal display device comprising:

a plurality of pixels, each pixel comprising a liquid crystal, whose incident light transmittance corresponds to an OFF state, the liquid crystal display device being configured so that:

a plurality of pulses having a first voltage can be applied to the pixel in a first period which is a first part of a frame period so as to modify the light transmittance in the first period, each pulse having a width shorter than a rise time which is a time that the light transmittance of the liquid crystal element takes to change to a gray-scale state when a reference voltage, lower than the first voltage, is applied to the liquid crystal element, the pulses can be separated from each other by an interval of time substantially equal to the width of the pulses;

a constant non-null second voltage can be applied to the pixel in a second period which is a second part of the frame period, situated after the first period, the incident light transmittance of the pixel can be changed from the OFF state to the gray-scale state in the first period and maintained in the gray-scale state in the second period, a third voltage, lower than an absolute value of a threshold voltage, can be applied to the pixel in a third period which is a third part of the frame period, situated after the second period, and an absolute value of the first voltage can be higher than the constant non-null second voltage, wherein the third period would be substantially equal to a fall time defined as a time necessary for the incident light transmittance of the liquid crystal element to change from the gray-scale state to the OFF state when no voltage is applied.

* * * * *